US007498498B2

(12) United States Patent
Lerner

(10) Patent No.: US 7,498,498 B2
(45) Date of Patent: Mar. 3, 2009

(54) DRUM STRUCTURES HAVING TURN-ON DRUMHEAD TUNING AND SPHERICAL ACOUSTIC CHAMBERS

(76) Inventor: Robert Lerner, 739 2nd St., #3, Miami Beach, FL (US) 33139

( * ) Notice: Subject to any disclaimer, the term of this patent is extended or adjusted under 35 U.S.C. 154(b) by 252 days.

(21) Appl. No.: 11/161,749

(22) Filed: Aug. 15, 2005

(65) Prior Publication Data

US 2006/0174749 A1 Aug. 10, 2006

Related U.S. Application Data

(60) Provisional application No. 60/593,691, filed on Feb. 4, 2005.

(51) Int. Cl.
*G10D 13/02* (2006.01)

(52) U.S. Cl. ..... 84/411 R

(58) Field of Classification Search ..... 84/411 R, 84/421; 446/318, 418
See application file for complete search history.

(56) References Cited

U.S. PATENT DOCUMENTS 4,373,419 A * 2/1983 Tuttrup ..... 84/411 R
4,577,541 A * 3/1986 Edge ..... 84/411 R
4,870,883 A * 10/1989 Gauger ..... 84/413
5,739,448 A * 4/1998 Toscano ..... 84/413
6,479,737 B1 * 11/2002 Lebeda ..... 84/422.4
6,838,606 B2 * 1/2005 Chiang ..... 84/414
6,891,097 B2 * 5/2005 Wilfer ..... 84/411 M
7,138,574 B1 * 11/2006 Spinazzola ..... 84/411 R
2003/0061929 A1 * 4/2003 Dye et al. ..... 84/411 R

OTHER PUBLICATIONS

Printout from website: www.thedrumworks.com/customer/product.php?productid=176.

* cited by examiner

*Primary Examiner*—Kimberly R Lockett
(74) *Attorney, Agent, or Firm*—Fox Rothschild LLP

(57) ABSTRACT

A turn-on tuning system comprising threaded tuning rims or drumheads with threaded frames in place of lugs used by conventional drums, and a spherical acoustic chamber to provide both acoustic and visual improvements over prior art instruments. The tuning system secures a drumhead to a drum by either sandwiching the drumhead between a threaded drum shell and a threaded rim or by directly attaching the drumhead to the threaded drum shell via a threaded frame integral with the drumhead. The drum is tuned by rotating the rim or drumhead to increase pressure on the drumhead. The spherical acoustic chamber, which may be attached to or in place of a traditional drum shell, provides enhanced audio quality and may also provide housing for electronic equipment or acoustic elements which may be held within the spherical chamber. The spherical acoustic chamber also provides numerous visual improvements.

18 Claims, 12 Drawing Sheets

DRUM STRUCTURES HAVING TURN-ON DRUMHEAD TUNING AND SPHERICAL ACOUSTIC CHAMBERS

CROSS-REFERENCE TO RELATED APPLICATIONS

This application is related to, and claims the benefit of, the provisional patent application entitled "Drum Structures Having Lugless Drumhead Tuning and Spherical Acoustic Chambers," filed Feb. 4, 2005, bearing U.S. Ser. No. 60/593,691 and naming Robert Lerner, the named inventor herein, as sole inventor, the contents of which is specifically incorporated by reference herein in its entirety.

BACKGROUND OF THE INVENTION

1. Technical Field

The present invention relates to musical instruments. In particular, it relates to a new turn-on tuning mechanism for a drum and spherical acoustic chambers that provide both audio and visual improvements over the prior art.

2. Background

The music industry uses drums with almost every type of music. While some drums may be suitable for every type of music, other drums may be more suitable for particular types of music. The wide variety of music categories has resulted in the development of many types of drums. For example, drum sets or drum kits used by rock-and-roll bands can vary from drums used by orchestras or other musical combinations. A wide variety of drums have been developed for these various purposes and types of music, such as bongos, square drums, percussion drums, bass drums, kettle drums, tom-tom drums, and tympani drums. In addition to acoustic drums, many drums have also been simulated, or enhanced, by electronic devices.

Each of the many types of drums that have been developed have their own unique sound qualities. As a result, bands and orchestras typically require many types of drums to produce the various sounds required for a particular musical work. Depending on the intent of the artists, variations in acoustic qualities for particular musical instruments may improve the nature of a given musical work. It would be desirable to have a method of altering the sound quality of existing drums to create particular acoustic effects.

Another problem associated with the use of drums is that they require a substantial amount of skill and effort to properly tune. Drums are typically tuned by adjusting a series of lugs arranged around the periphery of the drum head. It would be desirable to have a method of tuning drums that takes less time, does not require a high skill level, and is convenient.

SUMMARY OF THE INVENTION

The present invention provides spherical or spheroid-shaped drums and a turn-on drum tuning system that uses threaded tuning rims or a threaded drumhead frame in place of lugs used by conventional drums. The spherical drums may be used with traditional lug tuning systems or with the turn-on tuning system of the present invention. Similarly, the turn-on tuning system of the present invention may be used with spherical drums according to the invention or with traditional drums. A spherical or spheroid acoustic chamber provides both acoustic and visual improvements over prior art instruments. The tuning system uses, in a first embodiment, a drum head which is secured to a threaded drum shell with a turn-on rim. In a second embodiment, the drumhead, which comprises a striking surface and frame, has a threaded frame that may turn onto a threaded drum shell. A further feature of the invention is the spherical or spheroid acoustic chamber. The spherical or spheroid acoustic chamber provides an enhanced audio quality and may also provides housing for electronic equipment or additional acoustic elements, which may be held within the acoustic chamber. In addition, the spherical or spheroid acoustic chamber provides numerous visual improvements, and it allows for lighting which may be programmed for entertainment purposes.

DETAILED DESCRIPTION

Figure 1A:
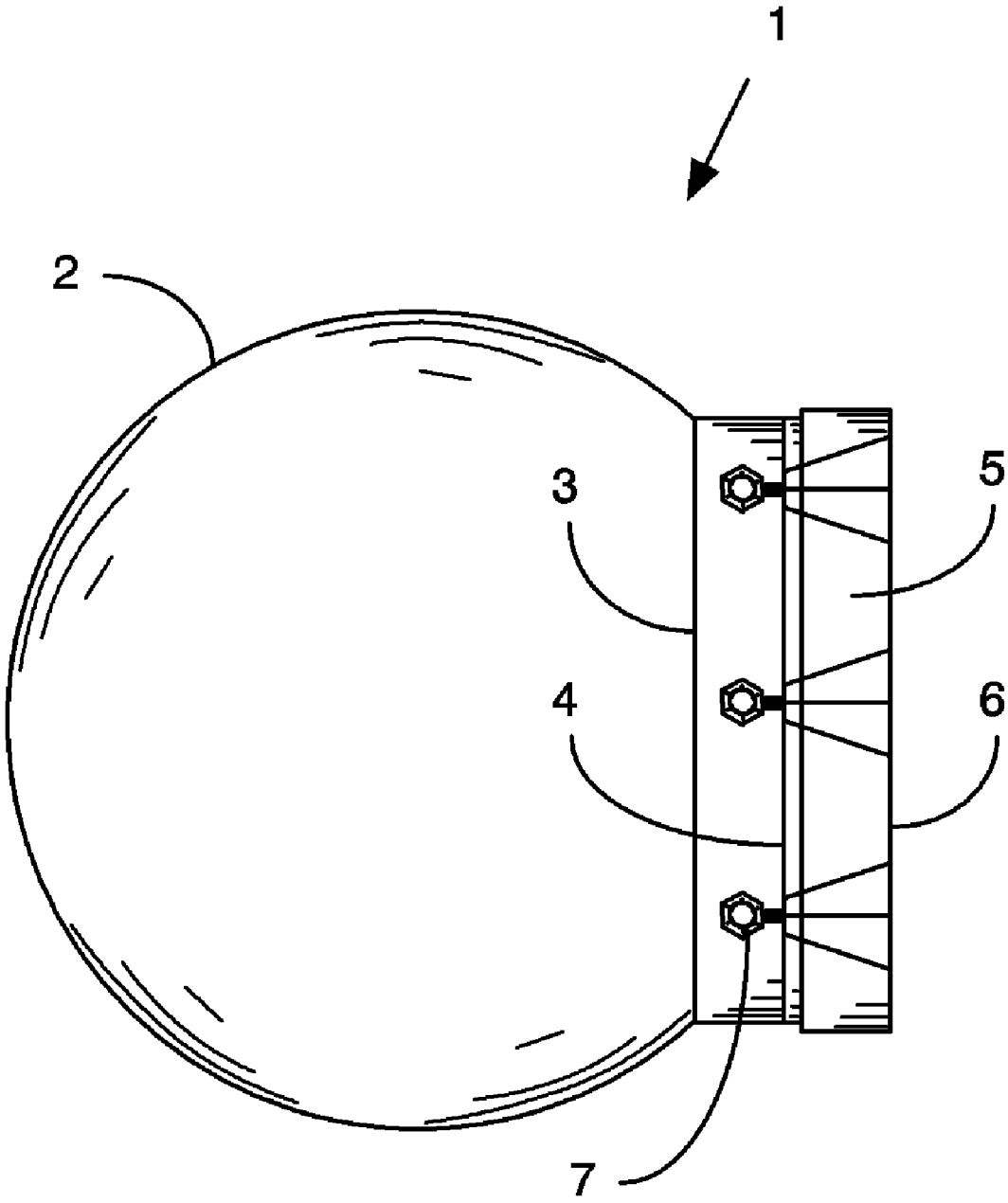
FIG. 1A illustrates a side view of a preferred embodiment of the invention, which illustrates a drum shell with a spherical acoustic chamber attached to the drumhead.

Prior to a detailed discussion of the figures, a general overview of the system will be presented. This invention provides a system and method for tuning drumheads along with a spherical or spheroid-shaped acoustic chamber, which improves audio and visual quality and provides additional visual entertainment options. It is to be understood that the terms spherical and spheroid are interchangeable as used in this specification; therefore, any description concerning a spherical or spheroid chamber is applicable to a spheroid or spherical chamber, respectively.

Tunable drums are conventionally assembled by tunably engaging a drumhead with a drum shell. The edge of the shell that contacts the drumhead is referred to as the bearing edge. A drum is tuned by adjusting the tension on the drumhead. Conventional drums are tuned using a series of lugs, which are mounted on the drum shell. Tightening or loosening the lugs adjusts the pressure on the drumhead by the bearing edge. To properly tune the drum, each of the different lugs must be carefully adjusted to provide the proper tension on the drumhead, which will then provide the desired audio qualities. In a preferred embodiment of the present invention, a prior art drumhead (which typically consists of a plastic sheet which the drumstick strikes and a tube frame that supports it) is sandwiched between the rim 9 and the bearing edge 11 of the drum 1. The rim and the drum have threaded surfaces which allow them to be secured together. By sandwiching the drumhead between a threaded rim and the bearing edge of a threaded drum, the drum can be acoustically tuned with equal tension on all sides. An alternative preferred embodiment provides a new drumhead mounting assembly which allows the drumhead to be threaded directly onto the threads on the drum. The new drumhead has threads that secure it to the threaded drum by gradually tightening it equally on all sides, thereby producing the proper tension and tonality. The drumhead is tuned by rotating the drumhead on the threaded section of the drum to gradually increase tension.

In an additional embodiment, the invention provides a spherical acoustic chamber. The spherical acoustic chamber provides an improved audio quality, which gives a unique sound to whatever musical piece the musician is playing. The drum shell may be positioned between the drumhead and the spherical acoustic chamber, unless a one-piece design is used in which the spherical acoustic chamber, the shell, and the bearing edge (and other desired elements) may be molded as a single piece. In one embodiment, the drumhead is then placed on the shell and secured by the rim. The shell and the rim have threaded surfaces which, when rotated, tighten the drumhead and alter the pressure on it to tune it. Alternatively, the new threaded drumhead assembly may be used, allowing the drumhead to be tightened directly on the shell without use of a separate rim.

In addition to the acoustic qualities produced by the invention, another important feature of the invention is that it provides a unique visual appearance. In practice, drums are often used in sets containing several independent drums are of different sizes. When multiple drums of the present invention are used, the combination of differently sized spherical acoustic chambers results in a unique visual impact that resembles a "molecule" structure. The spherical shape provides another advantage. Namely, due to the size of the spherical acoustic chambers, they allow additional features to be added. For example, internal lighting can be provided which can be programmed or illuminated in response to sounds produced by the drums. Further, electronic equipment that will allow the drum to produce electronic music rather than acoustic music can be concealed within the spherical acoustic chamber. In addition to illumination, sensors within the drum can detect when the drum is struck for the purpose of illuminating the drum whenever it is struck, thereby controlling the illumination with the music. As can be seen, in addition to the unique visual appearance of these drums, they can also have a variety of built-in functional equipment which will improve the performance both from an audible and visual standpoint.

It should be noted that while drums are often fabricated from materials such as wood, metal, etc., different types of drums are usually fabricated from different materials. For example, wooden drum hoops are typically used on bass drums, whereas smaller drums (e.g. tom toms etc.) generally use metal rims. The drums with spherical acoustic chambers are not limited in terms of the material used to fabricate them any more than any other type of drum. As a result, these drums provide the artist with wide latitude in the materials used. The only limitation is the effect the selected materials have on the sound produced by the drum.

Having provided a general overview of the turn-on tuning and spherical acoustic chamber, a more detailed discussion of the figures is provided.

FIG. 1A illustrates a side view of a preferred embodiment of a drum 1, which uses a spherical acoustic chamber 2. In this figure, the spherical acoustic chamber 2 has an extension 3 that is secured to the drum shell 4. In turn, the prior art lugs 7 are used to secure the hoop 5. The drumhead 6 is secured between the hoop 5 and the drum shell 4. As can be seen from this figure, the spherical acoustic chamber 2 provides a unique new shape and overall appearance to the drum 1. Those skilled in the art will recognize that a complete drum set having numerous drums 1 will provide a startling visual appearance to the audience.

Those skilled in the art will recognize that the size of a sphere-shaped drum provided by the invention can vary depending on the particular type of drum 1. It is envisioned that the spherical acoustic chamber 2 can be used with any size or type of drum 1. For example, the spherical acoustic chamber can be used with bongos, square drums, percussion drums, base drums, kettle drums, tom-tom drums, or tympani drums. As a result, the size of the spherical acoustic chamber 2 will vary over a wide range with virtually no limitations except for desired sound and manufacturing capabilities. Diameter sizes of the spherical acoustic chamber 2 may typically range from two foot six inches to one foot one inch. Likewise, the drum shell will be sized according to the diameter of the spherical acoustic chamber and the desired audio and visual effects. As an example, in one embodiment, the drum shell 4 may be sized at approximately five inches. The foregoing sizes are suggestive of how the invention may be implemented. However, it is to be understood that size is not critical and can vary substantially depending on the type of drum, the size of the drumhead 6, and the desired audio and visual effects.

In addition to size, the designer has a substantial number of options in terms of the material used to construct the drum 1. It can be made from any suitable transparent, translucent, opaque, or colored material, such as wood, metal, glass, plastic (including glow-in-the-dark plastic), resin, fiberglass, polyethylene, polypropylene, etc. In fact, any material which has suitable acoustic and visual properties can be used. In addition, the spherical acoustic chamber 2 can also be decorated with colors, images, lettering, etc., such that any number of visual themes can be presented to the audience.

In addition to variations in the size of the spherical acoustic chamber 2 and the type of material used to fabricate it, the spherical acoustic chamber 2 can also vary in shape. For ease of illustration, a spherical acoustic chamber 2 has been used to illustrate the invention. While a spherical acoustic chamber 2 is shown in the figure, those skilled in the art will recognize that alternative shapes can be used to implement this invention. The shapes can be perfect spheres, oblate spheroids, elliptical spheroids, etc. For ease of discussion, it is to be understood that the term "spherical acoustic chamber" or similar terms as used in this specification may refer to any of the foregoing shapes. The only restriction is that the spherical acoustic chamber 2 be able to attach to the particular drum shell 4, threaded collar 12, or drumhead 6 in question. Of course, one skilled in the art will recognize that a drum according to the present invention may be fabricated as a single piece, requiring attachment of only the drumhead. For example, if the acoustic chamber is to be attached to a shell with a threaded collar and bearing edge, all of these elements may be integral rather than separate parts that need to be assembled.

Figure 1B:
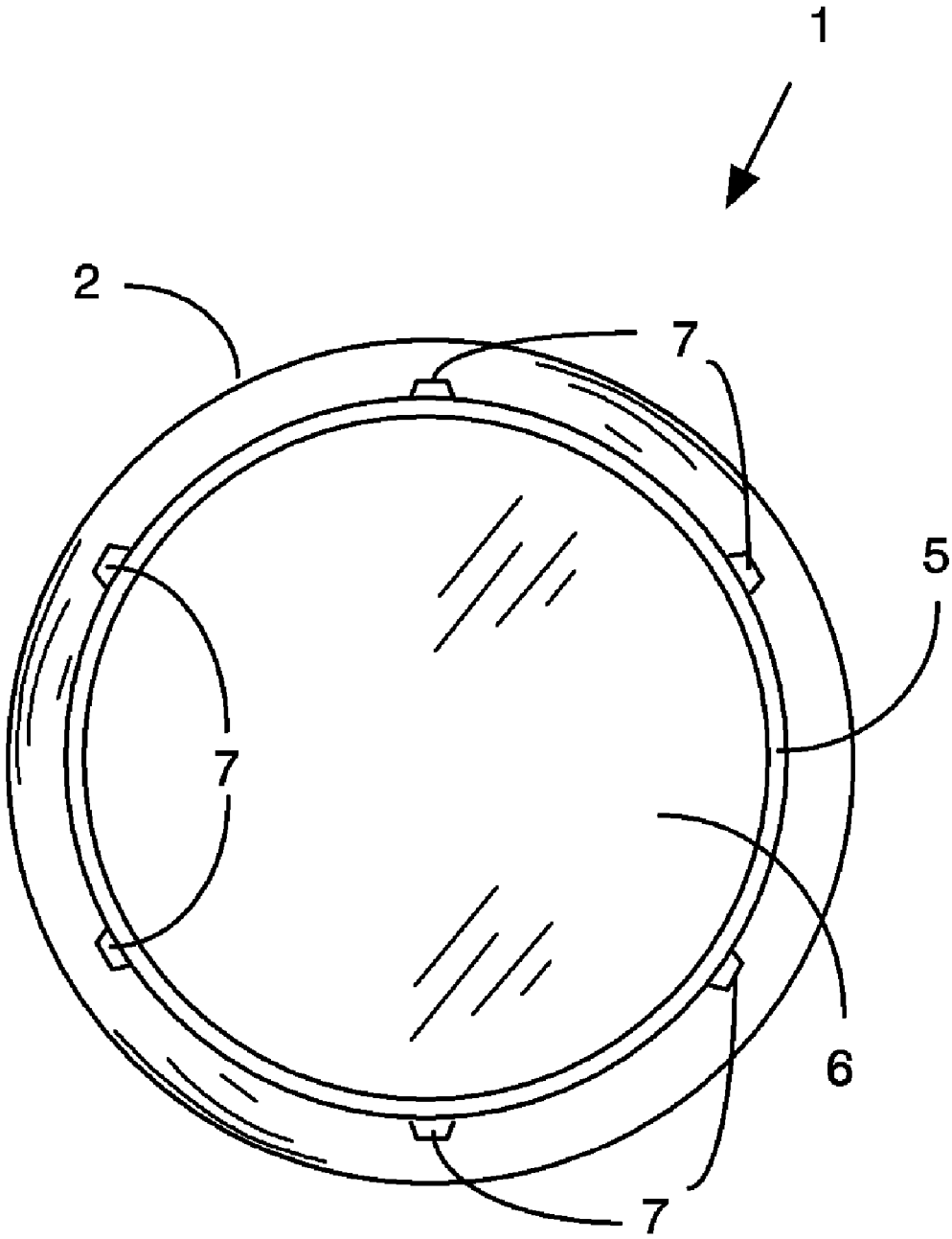
FIG. 1B illustrates an edge view of a preferred embodiment of the invention, which illustrates the drumhead mounted on the drum shell with the spherical acoustic chamber.

FIG. 1B illustrates an end view of a preferred embodiment of the invention which illustrates the drumhead 6 mounted on the hoop 5 which is in turn attached to spherical acoustic chamber 2. Also shown in this figure are optional lugs 7. In the prior art, lugs 7 would have been used to tune the drum 1. In the embodiment shown herein, the lugs 7 provide ornamental value, but the drum 1 does not require lugs 7 to function or for tuning purposes. If lugs 7 are used, they can be attached in a variety of ways. For example, they can be formed as part of the wall of the acoustic chamber 2 as integral attachments to the chamber, or as a conventional lug 7 secured to the drum shell 4, etc.

For ease of illustration, this figure shows the spherical acoustic chamber 2 as having a wider diameter than the drum shell 4. However, this is in fact not required to implement the invention. The diameter of the spherical acoustic chamber 2 may be the same as the diameter of the drum shell 4 or even less. Those skilled in the art will recognize that the spherical acoustic chamber 2 can vary in size to suit the audio and visual design goals of a particular drum set.

Figure 2A:
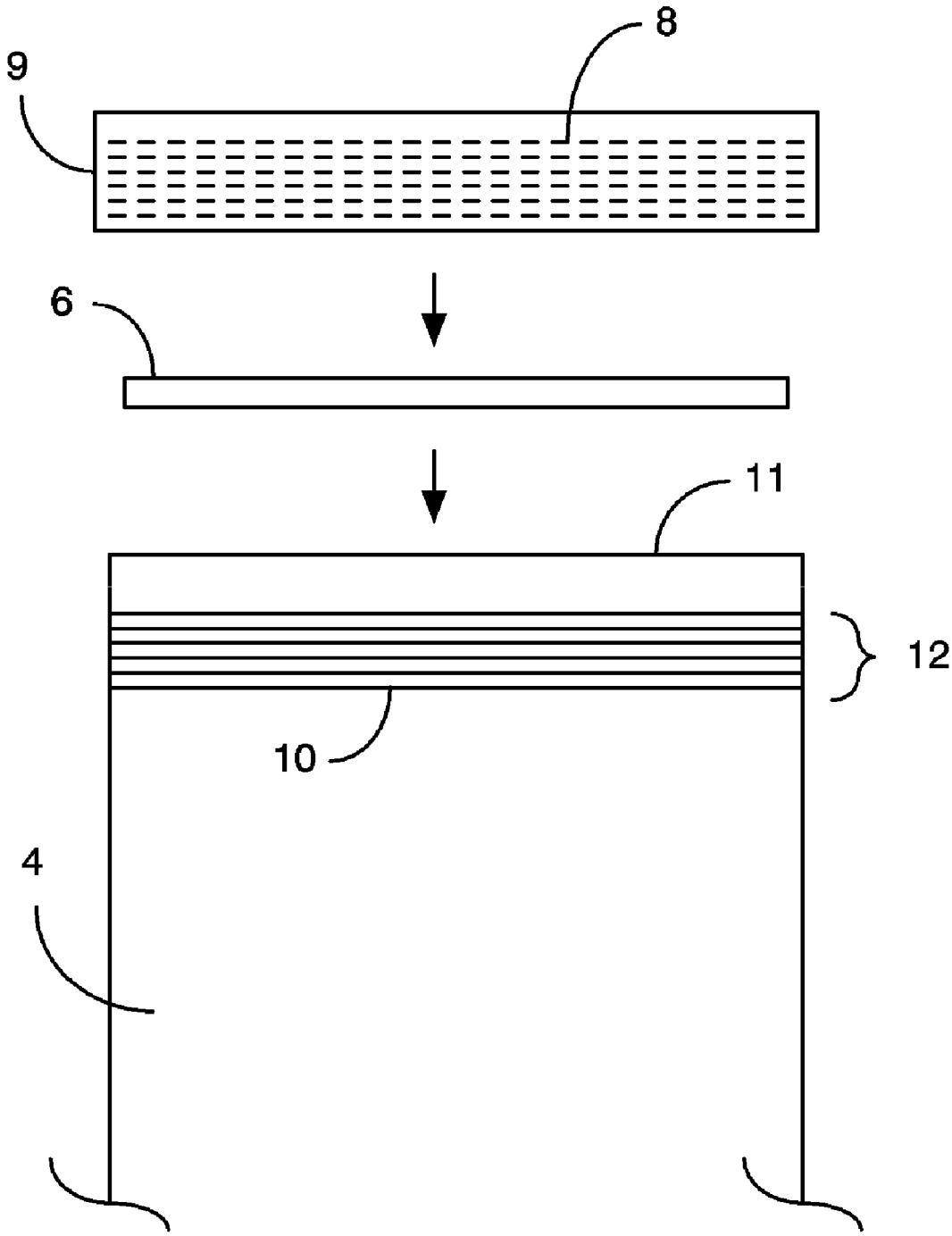
FIG. 2A illustrates a preferred embodiment of the invention in which a drumhead is being secured to a drum shell by a rim.

FIG. 2A illustrates a preferred embodiment of the drum 1 as used by the invention. The drumhead 6 is attached to a tuning rim 9. This figure also illustrates the location of female threads 8 which are located on the inside of the tuning rim 9. When the drumhead 6 and tuning rim 9 are attached to the drum shell 4, they are secured by threading the female threads 8 onto corresponding male threads 10 on the drum shell 4. Those skilled in the art will recognize that it does not matter whether the male threads 10 or the female threads 8 are on the drum shell 4 or the rim 9. It is only important that they can be joined together to secure the drumhead 6 to the drum 1, and to tune the drum 1 by tightening the drumhead 6. Thus, female threads 8 and male threads 10 may be reversed such that male threads are located on the inside of tuning rim 9 and corresponding female threads are located on the drum shell 4. Accordingly, it is to be understood that any reference in this specification to female threads 8 and male threads 10 applies equally to inverse arrangements of the threads. In a preferred embodiment, male threads are formed in a threaded collar 12 which is attached to the body of drum shell 4. Also shown in this figure is bearing edge 11. When tuning rim 9 is threaded onto corresponding male threads 10, with a drumhead in place, bearing edge 11 limits the distance which the tuning rim 9 can be threaded. It is preferred that rim 9 be fabricated from metal. However, any other suitable material may be used. Depending on how much tuning rim 9 is tightened to the drum shell 4, the pressure on the drumhead 6 will vary, thereby tuning the drumhead 6 equally on all sides.

Figure 2B:
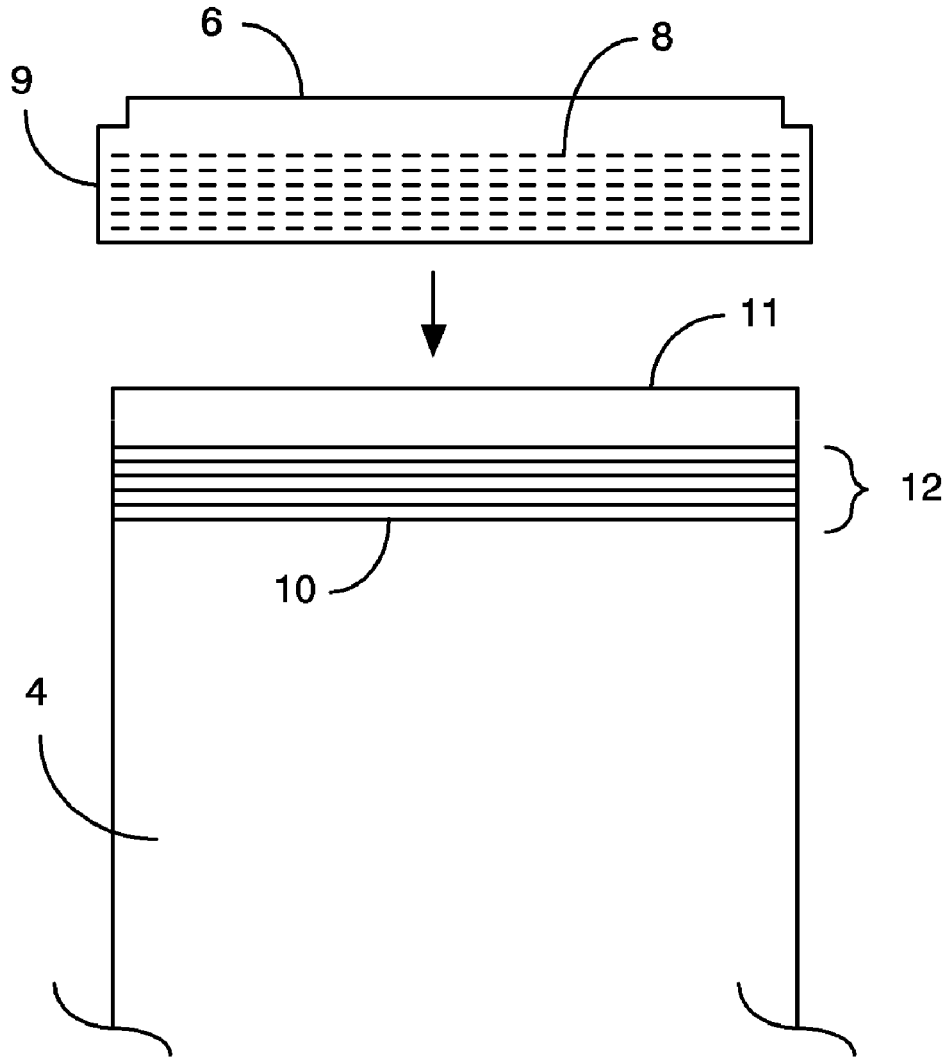
FIG. 2B illustrates another preferred embodiment of the invention in which an integrated drumhead/rim combination is being secured to a drum shell.

FIG. 2B illustrates an alternative preferred embodiment of the drum 1 as used by the invention. In this embodiment, drumhead 6 and the tuning rim 9 are fabricated as a single component. This is easily accomplished by expanding the tube frame 14 (illustrated in FIG. 5) such that it has a collar with a threaded inner surface which forms the tuning rim 9. This figure illustrates the location of female threads 8 which are located on the inside of the drumhead 6. When the drumhead 6 is attached to the drum shell 4, it is secured by threading the female threads 8 onto corresponding male threads 10 on the drum shell 4. In the preferred embodiment, male threads are formed in a threaded collar 12 which is attached to the body of drum shell 4. Also shown in this figure is bearing edge 11. When tuning rim 9 is threaded onto corresponding male threads 10, bearing edge 11 limits the distance which tuning rim 9 can be threaded. In a preferred embodiment, tuning rim 9 is fabricated from metal. However, any other suitable material may be used.

The threaded collar 12 is of any size appropriate for adequately securing the tuning rim. In a preferred embodiment, threaded collar 12 is relatively small, such as about 1.5 inches. However, this can vary depending on the material used, and on the size of the drum 1. Likewise, a preferred embodiment envisions the threaded collar being fabricated from metal. However, any other alternative material can be used provided that it is suitable for its intended purpose.

Figure 3:
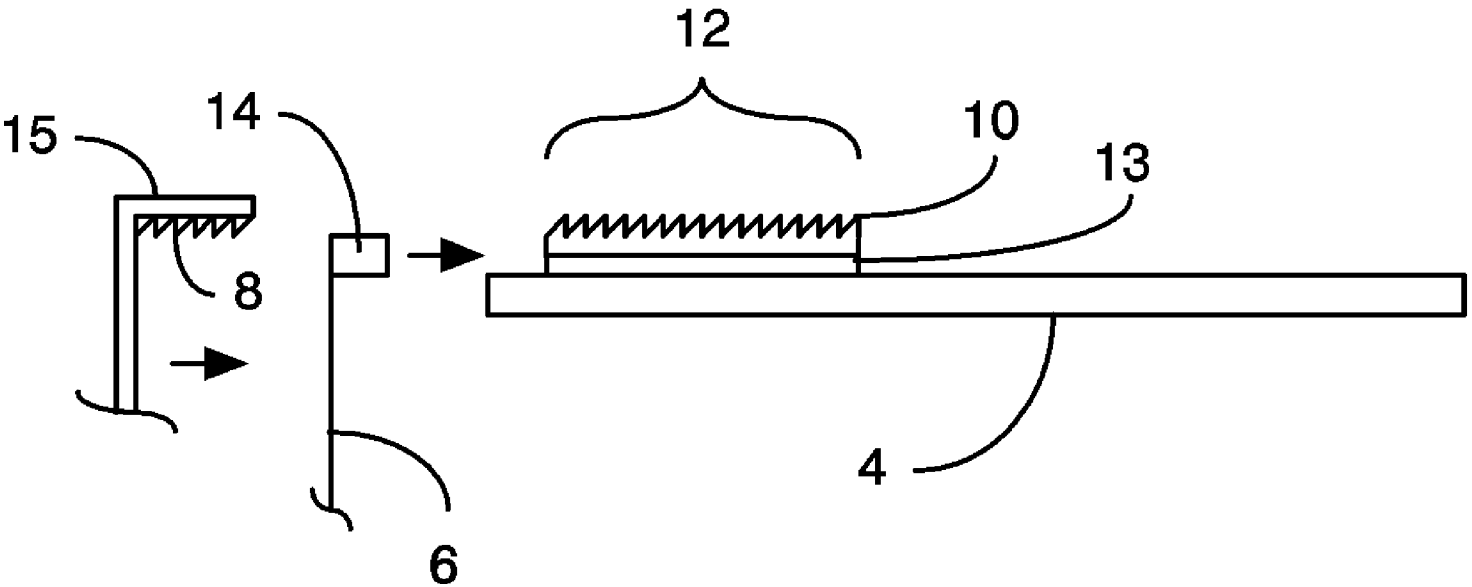
FIG. 3 illustrates a cross-sectional view of a preferred embodiment of the invention, which illustrates one method of how the drumhead may be assembled to the drum shell.

FIG. 3 is a cross-sectional view of a preferred embodiment of the invention which illustrates how the drumhead 6 is assembled to the drum shell 4. In this figure, the drumhead 6 is being mounted on the drum shell 4. As shown in this figure, the male threads 10 are secured to the drum shell 4 with a pliable gasket 13 positioned between the male threads 10 and the drum shell 4, which is typically fabricated from wood but may be fabricated from any other suitable material, such as metal, glass, plastic (including glow-in-the-dark plastic), resin, fiberglass, polyethylene, polypropylene, etc. During assembly, tube frame 14 is shown attached to the drumhead 6 and overlaps the edge of the drum shell 4. Once the drumhead 6 is attached to the drum shell 4, the tuning rim 15 is threaded onto the male threads 10 until the drumhead 6 is securely attached to the drum shell 4.

A preferred embodiment envisions a tube frame 14 which is fabricated from metal. However, those skilled in the art will recognize that any suitable material can be used so long as it is suitable for its purpose. Tube frames are known in the art.

This embodiment eliminates the need to tune the drum 1 with tuning lugs, as is done in the prior art. In this embodiment, the drumhead 6 is tuned by adjusting the tightness of the tuning rim 15 and the male threads 10. This provides an easier and more convenient way of adjusting the drumhead 6 tension. In summary, in this turn-on drum tuning embodiment, tuning rim 15 is designed to be threaded over the outside of the drum shell 4. This eliminates the need for lugs to be used and affords easier and more precise tuning of the drum 1. This system may be used for both acoustic and electronic drums.

Figure 4:
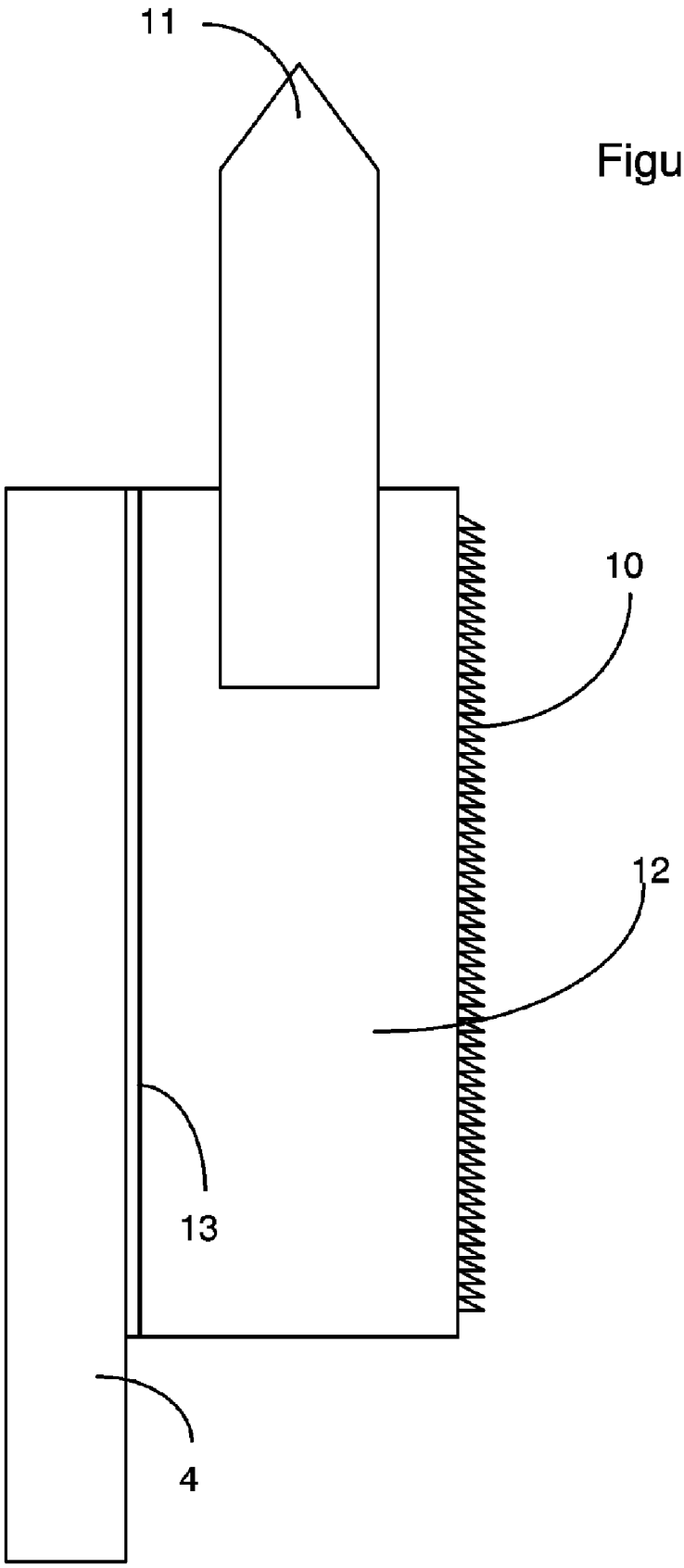
FIG. 4 is an edge cutaway view of the threaded collar of the drum shell. Also shown is the bearing edge, which is integrated with the threaded collar in this embodiment.

FIG. 4 illustrates a cutaway view of a preferred embodiment of the invention in which the bearing edge 11 and drum shell 4 are removably attached to the threaded collar 12. It is the bearing edge 11, pressing against the drumhead 6, which tunes the drum 1. As the rim 9 is tightened, the bearing edge 11 increases the pressure on the drumhead 6 to change the acoustic quality of the drum 1. Also shown in this figure is gasket 13, which reduces noise between the threaded collar 12 and the drum shell 4. Any suitable means, such as screws, adhesive, etc., can be used to attach the gasket 13 to the threaded collar 12 and the drum shell 4. A person of ordinary skill in the art will appreciate that when non-permanent means are used to attach the drum shell 4, gasket 13, threaded collar 12, and bearing edge 11, the parts may be disassembled or individually removed to permit repair or replacement if damaged or worn, or the parts may be substituted to alter the acoustic properties (e.g., different types of bearing edges).

Figure 5:
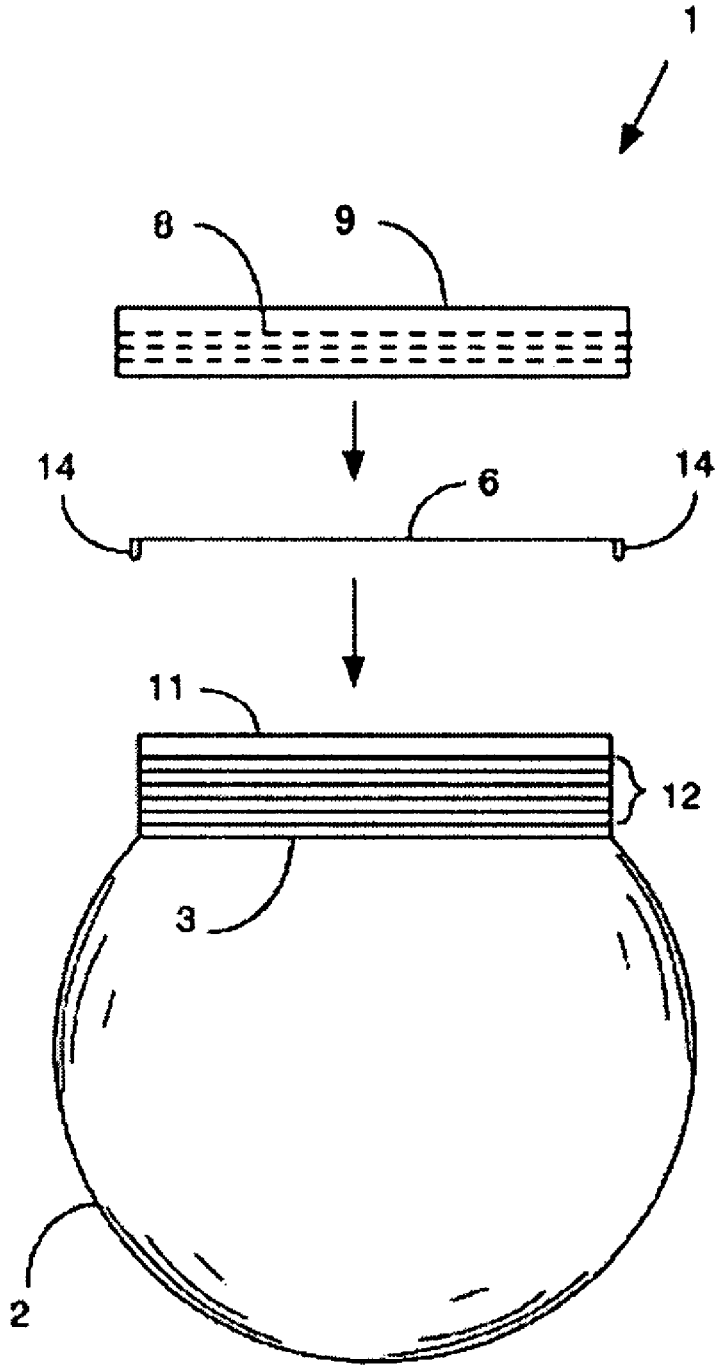
FIG. 5 shows a spherical acoustic chamber having a threaded collar aligned with a drumhead (cross-sectional view) and tuning rim.

In FIG. 5, a preferred embodiment of a spherical acoustic chamber 2 is shown being attached to a drumhead 6 and tuning rim 15. In this embodiment, the drumhead 6 is secured to a tube frame 14. The tube frame 14 is mounted over the bearing edge 11, and then is secured in place by threading tuning rim 15 onto threaded collar 12. The dashed lines 8 indicate the threading inside the tuning rim 15 which mates with threaded collar 12. The drumhead 6 is shown in a cross-sectional view to better illustrate tube frame 14 in relation to the striking surface of the drumhead.

Figure 6:
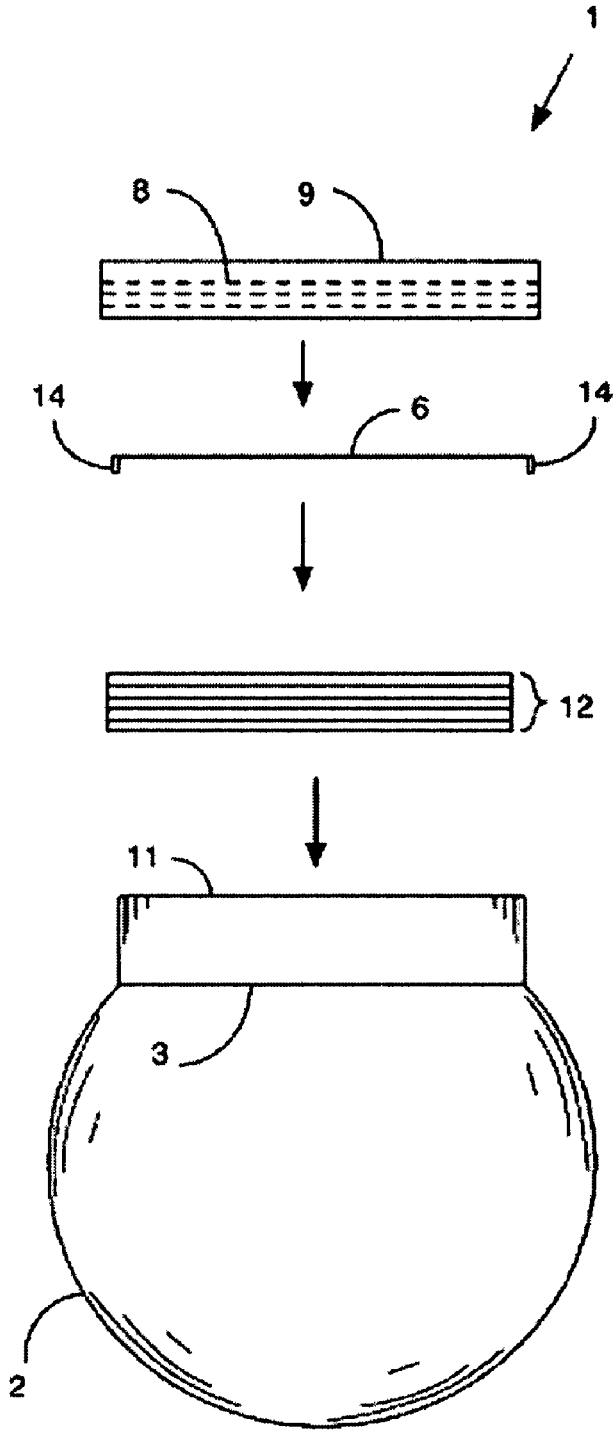
FIG. 6 illustrates an alternative preferred embodiment in which the spherical acoustic chamber has an extension which forms the bearing edge and attaches to the threaded collar.

FIG. 6 is an alternative preferred embodiment of the invention. In this embodiment, the spherical acoustic chamber 2 has an extension 3 which is sized to attach to the threaded collar 12. In addition, the edge of the extension 3 forms the bearing edge 11. The drumhead 6 and the tuning rim 15 attach in the same manner as before.

Figure 7:
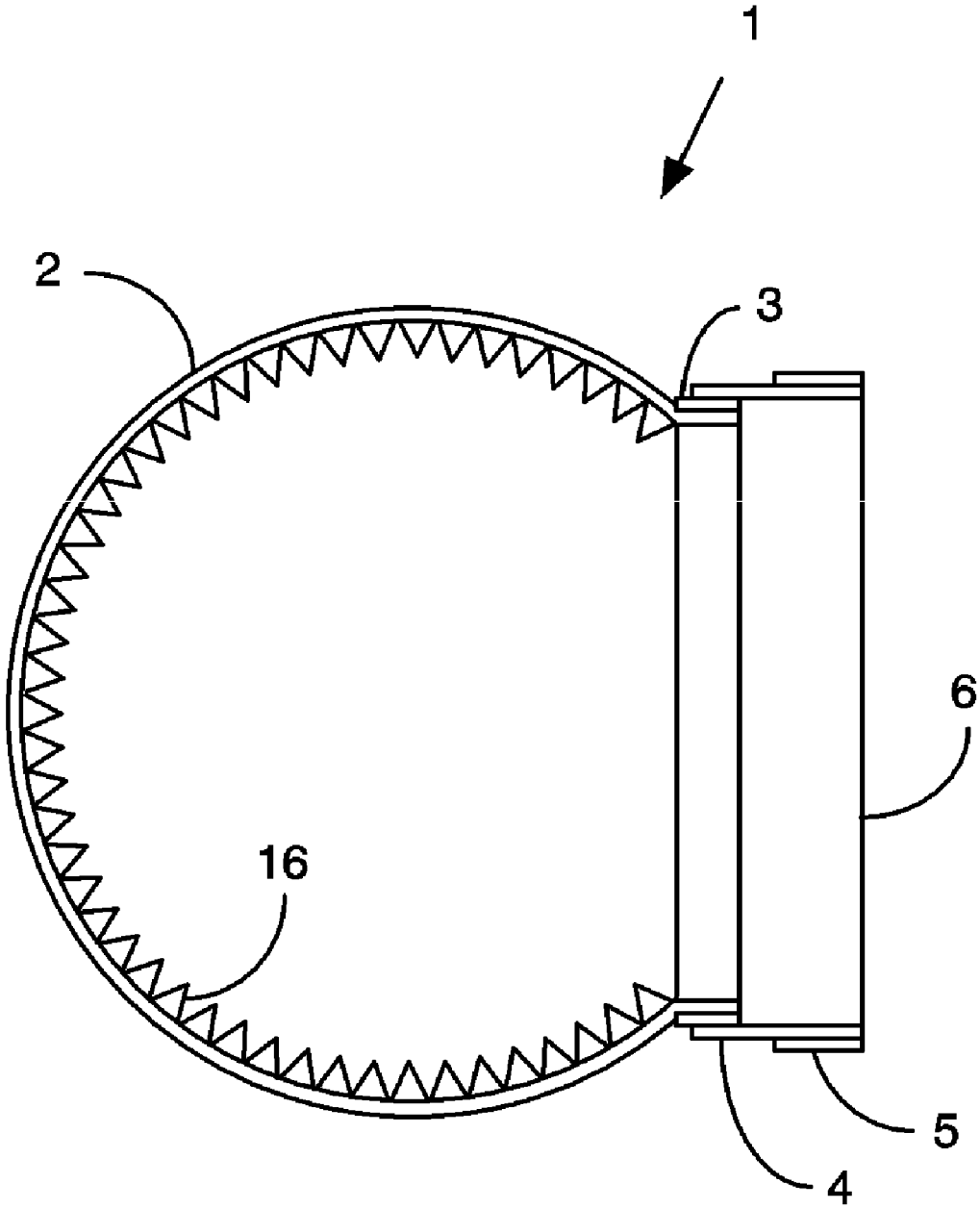
FIG. 7 illustrates an alternative preferred embodiment in which acoustic elements are placed inside the spherical acoustic chamber, or the interior of the drum may be contoured to produce specific changes in the sound produced by the drum.

FIG. 7 illustrates a cross-sectional side view of an alternative preferred embodiment of the spherical acoustic chamber 2. In this embodiment, optional acoustic elements 16 are placed inside the spherical acoustic chamber 2 of the drum 1 to produce specific changes in the sound produced by the drum 1. Alternatively, the acoustic elements 16 can be an integral part of the spherical acoustic chamber 2.

For ease of illustration, acoustic elements 16 are illustrated as having simple conical shapes. However, those skilled in the art will recognize that the acoustic elements 16 can take any shape that creates a desired acoustic effect. In a preferred embodiment, the acoustic elements 16 will be of a shape having peaks and valleys. Likewise, the material used to fabricate the acoustic elements 16 can vary based on the desired acoustic effect. For example, a soft material, such as foam or other material having similar properties, may be used to soften or dampen the sound, while a harder material may be used to intensify certain sound effects. Persons skilled in the art will recognize that any material that may soften, dampen, intensify, sharpen, or otherwise alter sound effects may be implemented. As a result, the amount of acoustic elements 16 used by a particular drum 1, as well as the material used to fabricate it, will vary depending on the intended use of the drum 1. For example, drums used by symphony orchestras may require a substantially different sound than a drum used by a heavy metal rock band.

The acoustic elements 16 can be permanently mounted inside the spherical acoustic chamber 2 or be an integral part of the spherical acoustic chamber 2. Those skilled in the art will recognize that they can also be removably attached to allow the musician to remove some or all of the acoustic elements 16 for a particular performance and reattach some or all of the acoustic elements 16 as desired. This can be accomplished in a variety of ways. For example, the acoustic elements 16 can be attached by adhesive, by double-stick tape, by snap-on attachments, or by any other suitable means. By allowing the acoustic elements 16 to be removably attached, the musician has much greater flexibility in what can be accomplished with that particular instrument.

Another way to alter the sonic performance of the drum 1 is to vary the materials which the spherical acoustic chamber 2 is fabricated from. For example, the spherical acoustic chamber 2 can be manufactured from material such as plastic or fiberglass which will result in specific types of sound. Likewise, it can be manufactured from other materials such as metal or wood which will produce different types of sound. When fabricating the spherical acoustic chamber 2, it should be noted that even when using a particular material, for example wood, the sound quality will vary based on a variety of factors such as thickness, wood density, wood type, etc. In general, the acoustic chamber 2 may be manufactured from any suitable material, such as wood, metal, glass, plastic (including glow-in-the-dark plastic), resin, fiberglass, polyethylene, polypropylene, etc.

Figure 8:
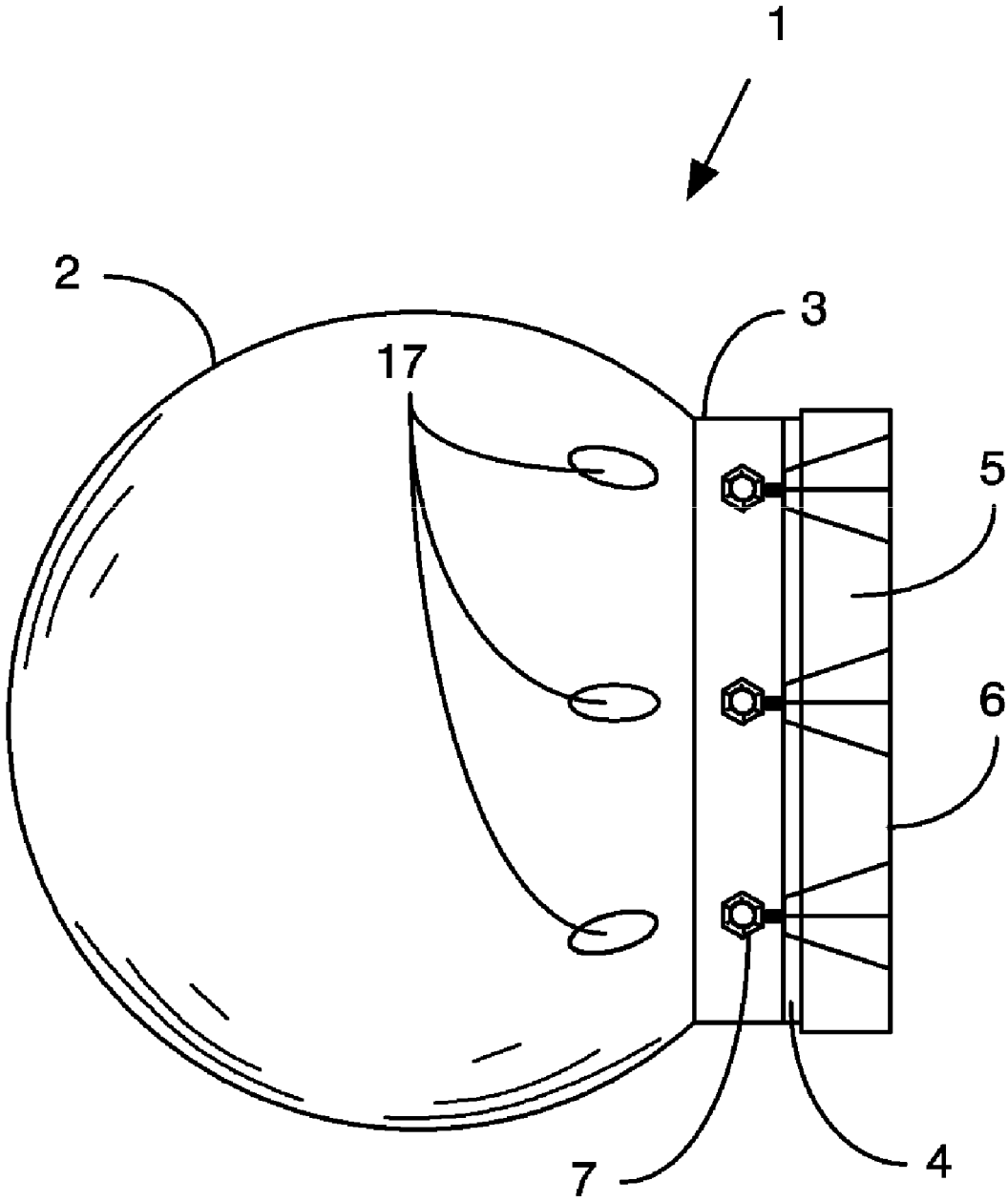
FIG. 8 illustrates another alternative preferred embodiment in which apertures are formed in the wall of the spherical acoustic chamber for the purpose of modifying the quality of the sound produced by the drum or for decoration.

FIG. 8 illustrates another alternative preferred embodiment of the spherical acoustic chamber 2. In this embodiment, apertures 17 are formed in the wall of the spherical acoustic chamber for the purpose of modifying the quality of the sound produced by the drum 1. For ease of illustration, the apertures 17 are illustrated having simple oval shapes. However, those skilled in the art will realize that the shape of the apertures 17 can vary depending on the effect they may have on the sound quality produced by the drum 1. Likewise, the shape of the apertures 17 can also vary based on their intended appearance.

For ease of discussion, each of the components of the drum are shown and discussed as discrete elements. However, those skilled in the art will recognize that many elements can be molded as a single unit to simplify the manufacturing process. Likewise, the drums may or may not use the turn-on tuning system. For example, if a one-piece molded drum is used, then lugs may be connected to the spherical acoustic chamber. Alternatively, if a turn-on tuning system is used on a one-piece molded drum (e.g. bearing edges with no shell) then an additional lip or collar area would be needed as to accommodate the threads unless such threads are molded as part of the one-piece drum.

Figure 9:
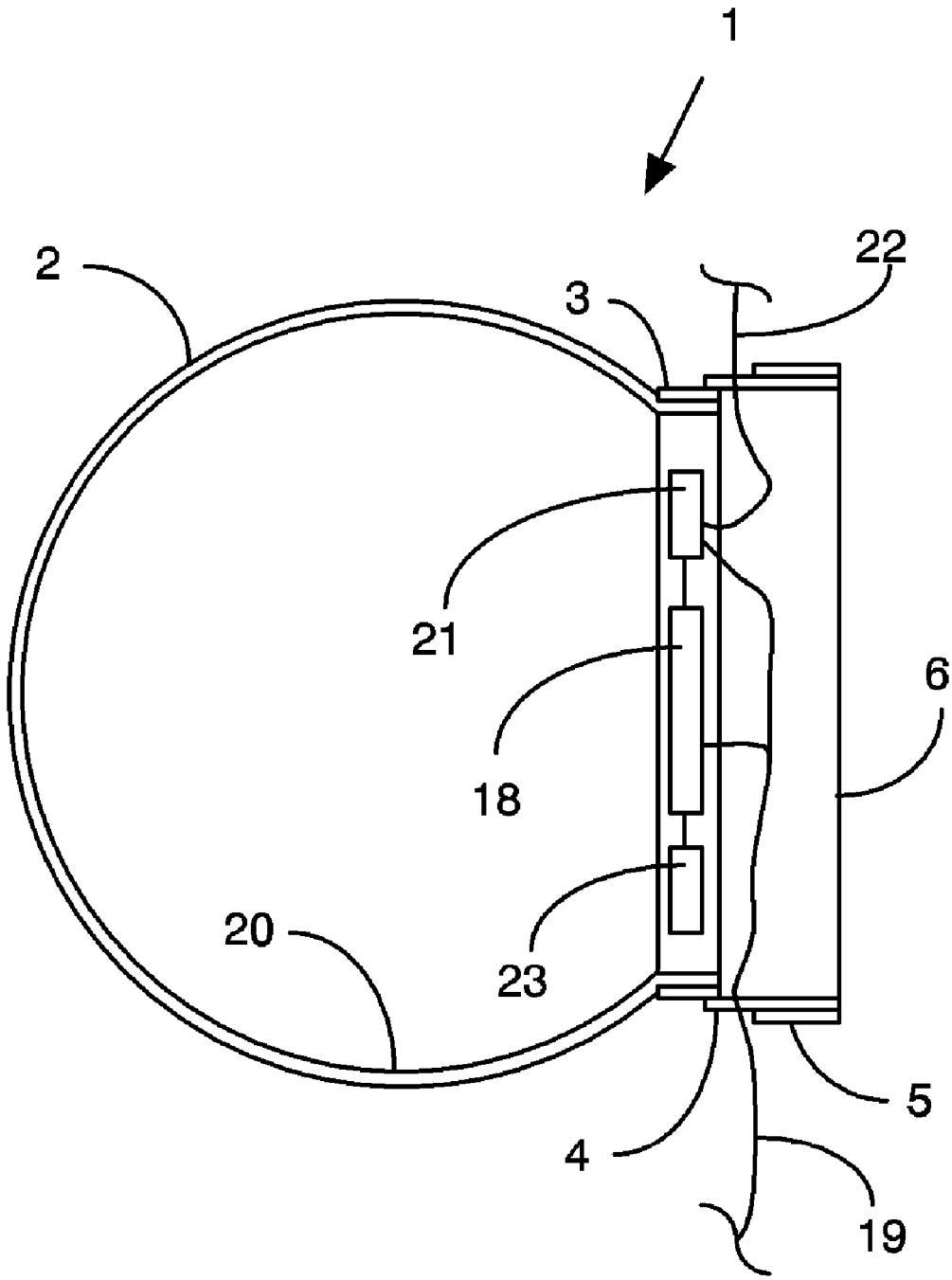
FIG. 9 illustrates another alternative preferred embodiment in which an interior lamp illuminates the spherical acoustic chamber from the inside.

FIG. 9 illustrates another alternative preferred embodiment in which an interior lamp 18 illuminates the spherical acoustic chamber 2 from the inside. The interior lamp 18 may be powered from a conventional power source (not shown) via power cord 19 which connects the interior lamp 18 to the power source. If the conventional power source is battery power, then power cord 19 may not be necessary or may not extend out of the drum. Also shown in this figure are optional lamp controller 21, optional lamp controller signal line 22, and optional sensor 23.

Illumination of the interior lamp 18 can be controlled in a variety of ways. For example, the interior lamp 18 in each drum 1 can remain in the power-on condition throughout a performance such that all of the drums are illuminated. Likewise, it is possible to switch some interior lamps 18 off in a given drum 1 set so that only pre-selected drums will be illuminated. Further, it is possible to dynamically control the drum 1 interior lamp 18 with optional lamp controller 21 and optional lamp controller signal line 22. If optional lamp controller 21 is used, it can be preprogrammed, either alone or in coordination with other drums 1 such that the drums 1 turn off their interior lamps 18 in a predetermined pattern. The sequence of interior lamp 18 illumination can be permanently stored in the lamp controller 21, it can be controlled remotely via lamp controller signal line 22, or it can have the sequence which is downloaded to a storage device in the lamp controller 21. The ability to manipulate illumination of the drums 1 allows the artist to adjust the illumination to suit a particular performance.

In addition to the preceding, the lamp controller 21 can also incorporate a sensor 23 to determine when a drum 1 has been struck by the musician. The lamp controller 21 can incorporate software which will allow the lamp controller 18 to control, using input data from sensor 23, illumination of the drum 1 such that it is synchronized with the sound being produced by the drum 1. Illumination can even be varied based on the intensity of the impact on the drum 1.

Those skilled in the art will recognize that lamp controller signal line 22 is illustrated as a physical signal line, however, it can just as easily be implemented as a wireless connection using a variety of available technologies. In addition, those skilled in the art will recognize that a lamp controller 18 can also be fabricated with sufficient intelligence to allow musicians to dynamically switch from one method of illumination to another via switches, remote control devices, etc. Those skilled in the art will also recognize that the lamps may be manipulated by either manual or automated control, consistent with the foregoing means.

Figure 10:
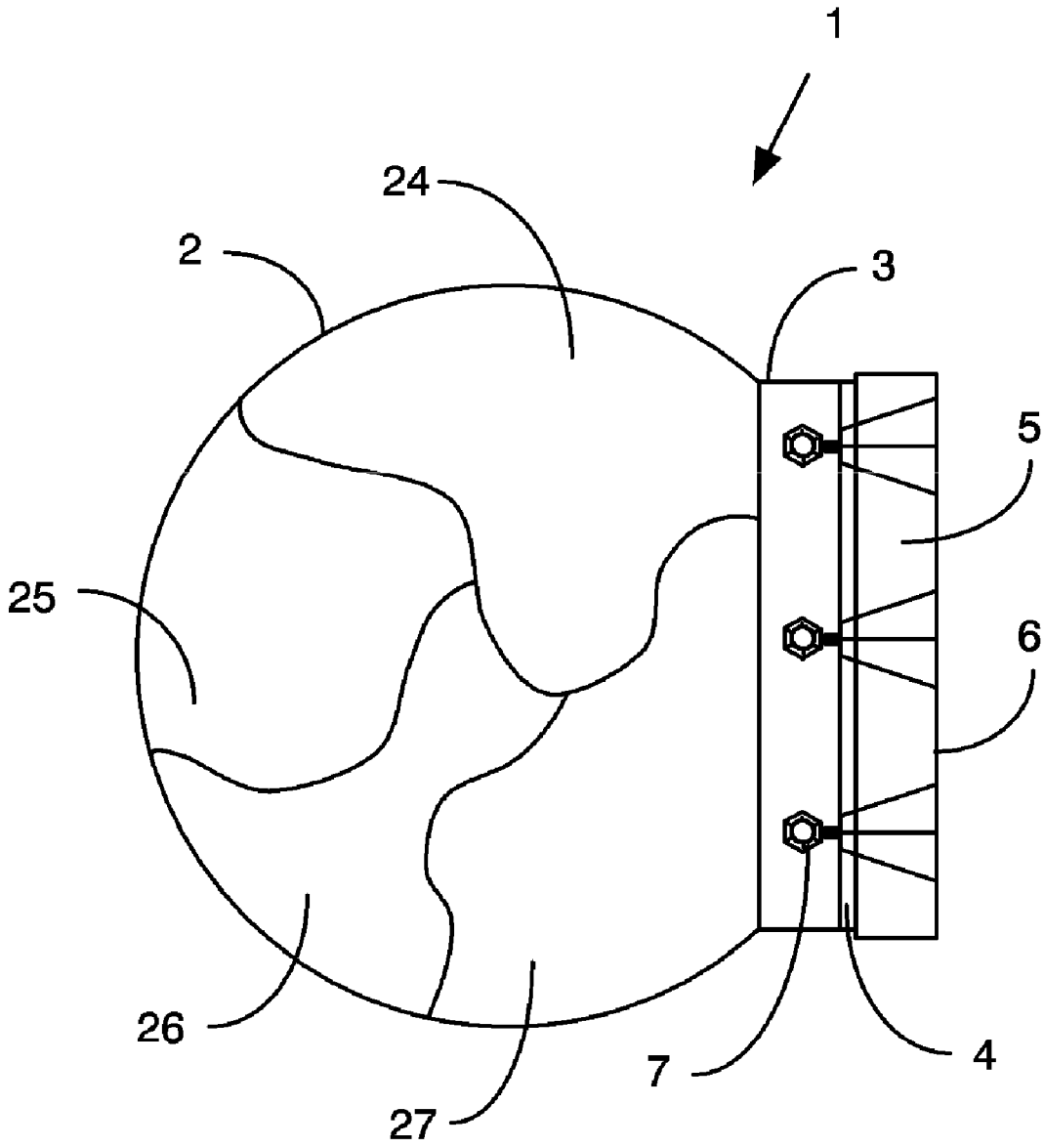
FIG. 10 illustrates another alternative preferred embodiment in which the spherical acoustic chamber has a decorative external design.

FIG. 10 illustrates another alternative preferred embodiment in which the spherical acoustic chamber 2 has a decorative external design which may incorporate any aesthetic theme. In this example, a pattern is produced by different colored segments 24-27. For ease of illustration, a simple pattern is shown in this figure. However, those skilled in the art will recognize that any aesthetic treatment can be used. The pattern can be a map of the globe, an individual's image, a photographic image, a reproduction of artwork, or any aesthetic treatment which is suitable for a particular performance. It is even possible to have removable aesthetic treatments which can be changed from one show to another.

The advantages of the embodiments of FIGS. 9-10 can be combined in a variety of ways. The interior lamp 18 can enhance the decorative external design by illuminating the drum 1 from the inside. Further, the interior lamp 18 does not have to be limited to conventional white light. For example, the interior lamp 18 can be an ultraviolet lamp designed to react with a decorative design that uses phosphorescent paint. Likewise, the drum can also be illuminated by colored light, laser light, or a projected image. This extends the range of possibilities for illumination of the drum 1. The drum 1 does not have to be used solely with one type of paint or one type of illumination. For example, combinations of conventional paint and phosphorescent paint can be used in combination with an interior lamp 18 which produces white light (i.e. the normal visual light spectrum), a colored light, laser lights, and/or ultraviolet light (commonly referred to as a black light). The availability of multiple types of illumination can be taken advantage of by the lamp controller 21 which may be programmed to produce an entertaining light show coordinated with a particular musical work.

This process enables an image to change during the performance. For example, when the white light is on, a first image applied to the spherical acoustic chamber 2 may be viewed. If phosphorescent paint is used to apply a second image on the spherical acoustic chamber 2, it will not be seen unless the interior lamp 18 containing the ultraviolet bulb is activated. As a result, one image can be displayed when only white light is applied, a second image can be displayed when only the ultraviolet light is applied, and a third image can be displayed when both white light and ultraviolet light is applied. In addition, combination of white light and black light can be enhanced by the addition of independent colored lights, laser lights and/or projected images to expand the capability of the lamp controller 21 to provide entertainment via the drum 1. This provides flexibility for the artist in designing an entertaining program which combines both music and visual entertainment.

While the invention has been described with respect to preferred embodiments thereof, it will be understood by those skilled in the art that various changes in detail may be made without departing from the spirit, scope, and teaching of the invention. For example, the spherical acoustic chamber can be used with a convention lug-based tuning system or a turn-on tuning system as provided by this invention. Likewise, the turn-on tuning system provided herein may be used on conventional drums. Accordingly, the invention herein disclosed is to be limited only as specified in the following claims.

What is claimed is:

1. A tunable drum, comprising:

a striking membrane;

a substantially cylindrical neck having a first end and a second end, wherein the first end is operably engageable to the striking membrane; and a substantially spherical acoustic chamber engaged with the second end of the substantially cylindrical neck, wherein more than 80% of the length of the acoustic chamber is substantially spherical.

2. The drum of claim 1, wherein the acoustic chamber is fabricated from wood, metal, plastic, fiberglass, glass, resin, polyethylene, polypropylene, combinations thereof, or any material having suitable acoustic properties.

3. The drum of claim 1, wherein the substantially cylindrical neck further comprises a threaded collar, and a tuning rim threadably engaged with the threaded collar, wherein the striking membrane is tunably engaged between the tuning rim and the threaded collar.

4. The drum of claim 3, wherein rotation of the threaded tuning rim on the threaded collar increases or decreases tension on the striking membrane, whereby the drum may be tuned by rotating the threaded tuning rim.

5. The drum of claim 1, further comprising: at least one aperture in the acoustic chamber.

6. The drum of claim 1, further comprising: at least one acoustic element inside the acoustic chamber, the acoustic element(s) being either permanently or removably attached to the interior of the acoustic chamber and being capable of altering acoustics of the drum.

7. The drum of claim 6, wherein the acoustic element(s) alter the acoustics of the drum by softening, dampening, intensifying, sharpening, altering pitch, or altering acoustic volume.

8. The drum of claim 1, further comprising one or more interior lamps.

9. The drum of claim 8, further comprising means to control activation of the interior lamps.

10. The drum of claim 8, further comprising means to manually activate the interior lamps.

11. The drum of claim 8, further comprising: a lamp controller capable of dynamically controlling activation of the interior lamps while the drum is static or in use.

12. The drum of claim 11, wherein the lamp controller dynamically controls activation and deactivation of the interior lamps by execution of a preprogrammed set of commands, a lamp controller signal line, a sensor that provides input data to the lamp controller, or combinations thereof.

13. The drum of claim 12, wherein the lamp controller signal line is either a hard-wired line or a wireless connection.

14. The drum of claim 1, further comprising: an aesthetic design on the acoustic chamber which may be illuminated by or reacts to activation of lamps.

15. The drum of claim 8, wherein each of the one or more interior lamps produces white light, ultraviolet light, colored light, laser light, internal image projection, or combinations thereof.

16. The drum of claim 15, wherein the one or more interior lamps are capable of independently or concertedly controlling activation of white light, ultraviolet light, colored light, laser light, internal image projection, or combinations thereof, and wherein independent lamps are capable of illuminating independent images.

17. The drum of claim 3, further comprising a drum shell integral with or attached to the acoustic chamber and a bearing edge integral with or attached to either the drum shell or the threaded collar.

18. The drum of claim 17, wherein the threaded collar is removably attached to the drum shell and the bearing edge is removably attached to either the drum shell or the threaded collar.

* * * * *